US005810238A

United States Patent [19]

Kunreuther

[11] Patent Number: 5,810,238

[45] Date of Patent: Sep. 22, 1998

[54] ATTACHMENTS FOR DOUBLE NEEDLE ATTACHER

[76] Inventor: Steven Kunreuther, 285 W. End Ave., New York, N.Y. 10024

[21] Appl. No.: 887,298

[22] Filed: Jul. 2, 1997

Related U.S. Application Data

[60] Continuation-in-part of Ser. No. 632,672, Apr. 15, 1996, Pat. No. 5,678,747, which is a division of Ser. No. 314,232, Sep. 28, 1994, Pat. No. 5,519,976.

[51] Int. Cl.[6] ..... B65C 7/00

[52] U.S. Cl. ..... 227/71; 227/67; 24/711.1; 206/343; 206/346

[58] Field of Search ..... 227/67, 71, 76, 227/156; 24/711.1, 711, 710.5, 72.7; 206/343, 346

[56] References Cited

U.S. PATENT DOCUMENTS

| | | | |
|---|---|---|---|
| 3,212,632 | 10/1965 | Baum et al. | 206/346 |
| 3,273,705 | 9/1966 | Rieger et al. | 24/711.1 |
| 4,039,078 | 8/1977 | Bone | 206/343 |
| 4,143,113 | 3/1979 | Suzuki . | |
| 4,183,894 | 1/1980 | Paradis . | |
| 4,197,075 | 4/1980 | Suzuki . | |
| 4,304,743 | 12/1981 | Paradis . | |
| 4,347,932 | 9/1982 | Furutu | 24/711.1 |
| 4,408,979 | 10/1983 | Russell . | |
| 4,416,838 | 11/1983 | Paradis . | |
| 4,429,437 | 2/1984 | Paradis . | |
| 4,533,076 | 8/1985 | Bourque . | |
| 5,020,713 | 6/1991 | Kunreuther . | |
| 5,383,260 | 1/1995 | Deschenes et al. . | |
| 5,417,325 | 5/1995 | Kunreuther | 24/711.1 |
| 5,579,976 | 12/1996 | Kunreuther et al. | 227/71 |
| 5,615,816 | 4/1997 | Deschenes et al. . | |

*Primary Examiner*—Scott A. Smith
*Attorney, Agent, or Firm*—James & Franklin; Robert L. Epstein, Esq.; Harold James, Esq.

[57] ABSTRACT

To reduce the force necessary to anchor the double "T" bar attachments, the filament of each attachment is made longer than the shortest (perpendicular) distance between the "T" bars to avoid the necessity of stretching the filament beyond its original length as it is dispensed. The filament lies in the same plane as the "T" bars to permit it to be fabricated on conventional stretching equipment. Preferrably, each end of the filament is formed at an acute angle relative to a line perpendicular to the "T" bar to which it is attached. The attachments can be supplied in continously connected ladder stock form or in a clip of parallel spaced attachments, situated between connector bars. In clip form, the attachments are fed along a correspondly shaped channel through the housing. In order to reduce the peak force necessary to sever the "T" bars from the respective connector bars, blades are located within the housing such that they cut at different times during the trigger stroke.

21 Claims, 7 Drawing Sheets

FIG. 8
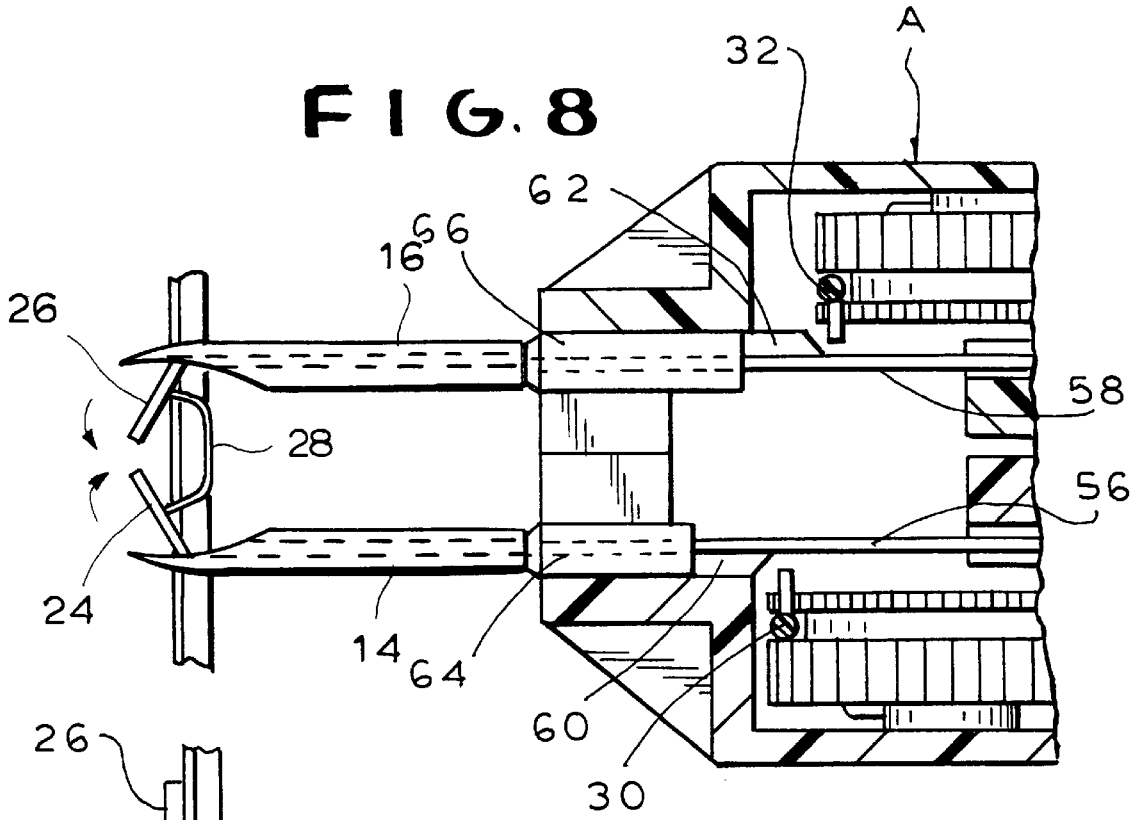
FIG. 9
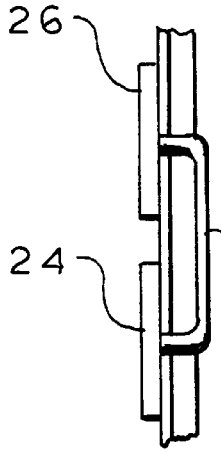
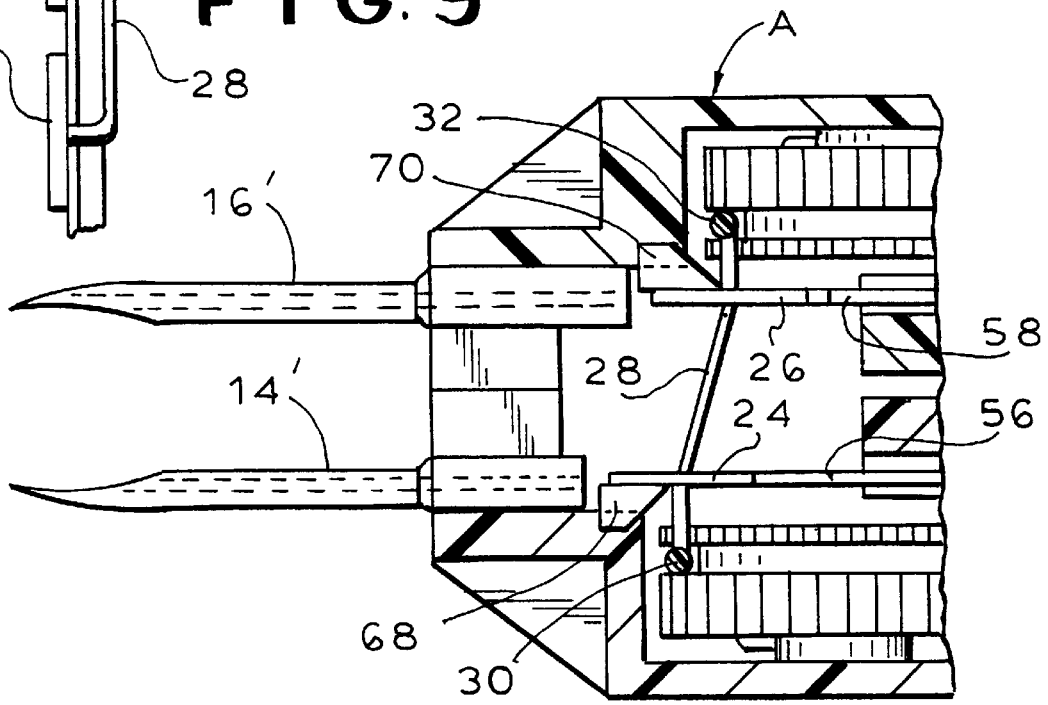
FIG. 10

ATTACHMENTS FOR DOUBLE NEEDLE ATTACHER

This application is a continuation-in-part of application Ser. No. 08/632,672 filed Apr. 15, 1996, now U.S. Pat. No. 5,678,747, which in turn is a divisional of application Ser. No. 314,232, filed Sep. 28, 1994 U.S. Pat. No. 5,519,976 issued Dec. 3, 1996.

The present invention relates to double "T" bar type plastic attachments more particularly to such attachments in which the filament of each attachment is longer than the shortest (perpendicular) distance between the "T" bars, lies in the plane of the associated "T" bars and each end of the filament forms an acute angle with a line perpendicular to the "T" bar to which it is attached. The attachments can be supplied in continously connected ladder form or in clips of parallel attachments between connector bars. The invention also relates to an attacher for dispensing and anchoring the attachments in clip form.

Attachers which dispense double "T" bar plastic attachments from clips with parallel connector bars, through fixed position, parallel, spaced, hollow needles are known. The attacher which is disclosed in my U.S. Pat. No. 5,020,713, issued Jun. 4, 1991 and entitled "Assembly of Attachments and Device for Attaching Same" is a good example.

Attachers designed to dispense attachments supplied in continous connected ladder form are disclosed in U.S. Pat. No. 4,533,076 entitled "Dispensing of Attachments" issued Aug. 6, 1985 to Donald L. Bourque and in U.S. Pat. No. 5,615,816 issued to Charles Deshenes et al. on Apr. 1, 1997. These patents teach different structures in which the needle support members are pivotally mounted to make them position adjustable to permit different size stock to be utilized. However, the apparatus disclosed in the aforementioned patents are only suitable for commercial use.

A significant advance in the art of double needle attachers designed for noncommercial use is represented by the attacher disclosed in U.S. Pat. No. 5,205,458 issued Apr. 27, 1993 entitled "Button Attacher With Variable Needle Spacing" . In that attacher, the halves of the attacher housing, each of which carries one of the needles, are flexibly joined by a living hinge. Squeezing the halves brings the needles closer together so as to quickly and easily alter the needle spacing to enable the attacher to accommodate buttons of different sizes.

Although the attacher of U.S. Pat. No. 5,205,458 easily accommodated different size buttons, that design has proved difficult to implement in practice because of fabrication problems. Specifically, using a single material which is molded into parts which are rigid in some areas and flexible in others proved difficult to achieve.

Of particular concern in manually operated double needle attachers is the amount of force which must be applied to the trigger of the attacher in order to dispense each attachment. Repeated use of the attacher can lead to operator fatigue. Thus, a significant advantage could be achieved if the force necessary to anchor each attachment could be reduced.

With regard to attachments supplied in clips, where the attachments are affixed to a connector bar, even with conventional single needle attachers, at the beginning of the trigger stroke, a relatively large amount of force is required to sever the attachment from its connector bar. When double "T" bar end attachments with parallel connector bars are involved, the force requirement at the beginning of the stroke becomes even more significant because the connector bars are both conventionally severed from the attachments at the same time. This increases the peak force required at the beginning of the stroke dramatically.

For attachments in clips and those supplied in continously connected ladder stock form, near the end of the trigger stroke, a large amount of force is required to anchor the attachment because the filament must stretch beyond its original length as the "T" bars are ejected from the needles and lodge on the opposite side of the fabric. This requires a great deal of force because in conventional attachments with stretched filaments, the mechanical stretching of the heated filament during fabrication creates a thin, flexible filament which is very strong and greatly resists further stretching. Thus, it would be highly advantageous to eliminate the need for stretching the filament beyond its original length as the attachment is anchored.

These problems are addressed in part in U.S. Pat. No. 5,579,976 entitled "Improved Double Needle Button Attacher" which issued Dec. 3, 1996 to Jack Kalbfeld and I and in the divisional of that case, Ser. No. 08/632,672, filed Apr. 15, 1996, now U.S. Pat. No. 5,678,747 issued Oct. 21, 1997.

There, a button attacher with variable needle spacing is disclosed in which the "T" bar ends of a conventional attachment in clip form with a stretched filament are severed from the connector bars at different times, reducing the peak force required at the beginning of the stroke. The force near the end of the stroke necessary to anchor the filament is reduced by using a uniquely structured trigger linkage. The linkage has a mechanical advantage which increases at an increasing rate as the stroke progresses.

In that attacher, the flexible housing parts are replaced by a rigid housing defining a cavity within which freely moveable members are mounted. These moveable members respectively support oppositely oriented spaced needles. Depressing protrusions accessible from the exterior of the housing moves the needle support members to alter the needle spacing.

In order to reduce the peak force necessary to sever the attachments from the connector bars, the connector bars are severed from the ends of each attachment at slightly different times during the trigger stroke. In one embodiment, this is achieved by using ejector or push rods of different length. In another embodiment, the rods are of equal length but are connected to the block which drives the rods at longitudinally offset locations. In a third embodiment, the needles, with their respective cutting blades, are mounted in longitudinally offset positions within the housing.

Anchoring a conventional double "T" bar attachment, where the stretched filament length is equal to the minimum distance between the "T" bars, requires that the filament be stretched beyond its original length. Since the attacher was designed to be used with conventional double "T" bar attachments in which the length of the filaments are equal to the minimum distance between the "T" bars, a mechanical solution to the force problem was incorporated into the design.

A triangular linkage associated with the trigger provided a mechanical advantage which increased at an increasing rate, transmitting maximum force towards the end of the stroke, as the filament connecting the "T" bars is stretched beyond its original length as the attachment was anchored. However, it has been found that even this trigger linkage does not deal with the increase in force completely.

In the present invention, the force during the initial portion of the ejection stroke is reduced by cutting the connector bars at different times, as in the apparatus disclosed in U.S. Pat. No. 5,579,976. However, here needles with different length bases are employed to obtain this result.

The force increase at the end of the stroke is avoided altogether through the use of a unique fastener configuration in which the filament is longer than the shortest (perpendicular) distance between the "T" bars, so that the filament need not stretch beyond its original length as the attachment is dispensed. The filament lies in the same plane as the "T" bars, so it can be fabricated using conventional stretching equipment. This structure can be applied to attachments supplied in clip or continous ladder stock form.

U.S. Pat. No. 5,383,260 issued Jan. 24, 1995 to Charles Deschenes entitled "Fastener Clip Including One or More Fasteners Adapted For Attaching Buttons To A Garment or Like Material" teaches the use of a double "T" bar fastener with a "U" shaped unstretched filament, which lies a plane perpendicular to the plane of the "T" bars. This structure allows the filament the ability to "expand" its effective length as the attachment is anchored.

However, the filament of the attachment disclosed in U.S. Pat. No. 5,383,260 is not mechanically stretched during fabrication. Because the filaments are not stretched, they are not as flexible, thin or strong as conventional stretched filaments. Stretching of this type of filament would not be possible on conventional stretching equipment because the "U" shaped filament does not lie in the same plane as the "T" bars.

In my attachment, the filament is longer than the shortest distance (perpendicular) between the "T" bars, and it lies in the same plane as the "T" bars. It therefore achieves all of the advantages of conventional stretched fasteners, including being able to be fabricated using conventional equipment, and at the same time eliminates the necessary of stretching the filament beyond its original length as the attachment is anchored. Thus, the overall force required to anchor the attachment is reduced.

In addition, in my invention, each end of the filament is attached to the associated "T" bar at an acute angle relative to a line perpendicular to the "T" bar. Thus, the "T" bars are offset with respect to the other in the plane of the attachment. This design most effectively accommodates the offset cutting blades which are adapted to sever the "T" bars from their respective connector bars.

It is, therefore, a prime object of the present invention to provide attachments for a double needle attacher in which the necessity for stretching the filament beyond its original length as it is anchored is eliminated.

It is another object of the present invention to provide attachments for a double needle attacher in which the filaments lie in the plane of the "T" bars, but are longer than the shortest (perpendicular) distance between the "T" bars.

It is another object of the present invention to provide attachments for a double needle attacher wherein each end of the filament is formed at an acute angle with respect to a line perpendicular to the associated "T" bar.

It is another object of the present invention to provide attachments for a double needle attacher wherein one "T" bar is offset relative to the other "T" bar, in the plane of the attachments.

It is another object of the present invention to provide a double needle attacher in which the cutting blades are offset so as to sever the "T" bars from their respective connector bars at different times in the trigger stroke.

In accordance with one aspect of the present invention, an attachment is provided for use in a double needle attacher. The attachment has a first and a second "T", bar connected by a filament. The filament lies in the plane of the "T" bars. It is longer than the shortest (perpendicular) distance between the "T" bars.

The filament has an end. The end is formed at an acute angle relative to a line substantially perpendicular to the axis of the "T" bar to which it is attached.

The filament has first and second ends. Each of the ends is formed at an acute angle relative to a line substantially perpendicular to the axis of the "T" bar to which it is attached.

The first "T" bar is offset relative to the second "T" bar in the plane of the attachment.

A double needle attacher is provided for dispensing and anchoring the attachments. Each of the needles of the attacher has an associated cutting blade. The cutting blade associated with the first needle is offset relative to the cutting blade associated with the second needle. Preferrably, the cutting blades are offset by a distance equal of the distance which the first "T" bar is offset from the second "T" bar.

Each needle includes a base. The base of the first needle is shorter than the base of the second needle. Preferably, the base of the first needle is shorter than the base of the second needle by a distance substantially equal to the distance which the the first "T" bar is offset relative to the second "T" bar.

In accordance with another aspect of the present invention, an attacher is provided for use with a clip of attachments of the type having first and second "T" bars connected by a filament. The attacher includes a housing and first and second needles attached to the housing in spaced, generally parallel relation. Each needle includes a base and an associated a cutting blade. The base of the first needle is shorter than the base of the second needle such that the cutting blade associated with the first needle is offset relative to the cutting blade associated with the second needle.

The cutting blades may be mounted on or be integral with the bases of the associated needles. Alternately, each cutting blade may be mounted in the housing of the attacher, proximate the base of the associated needle.

Preferably, one of the "T" bars is offset relative to the other. The base of the first needle is shorter than the base of the second needle by a distance substantially equal to the distance by which the first "T" bar of the attachment is offset relative to the second "T" bar of the attachment.

In accordance with another aspect of the present invention, a double needle attacher is provided for use with a clip of attachments situated in spaced parallel relation between first and second connector bars. Each attachment has a first and second "T" bar connected by a filament. The attacher has a channel along which the clip moves such that each attachment, in turn, aligns with the needles. The channel includes first and second portions adapted to receive the "T" bars respectively. The first portion of the channel is offset relative to the second portion of the channel.

The channel also includes a third portion adapted to receive the filaments of the attachments. The third portion extends in a direction other than the direction perpendicular to the first and second portions.

The filament of each attachment has an end. The end is formed at an acute angle relative to a line substantially perpendicular to the axis of the "T" bar to which the filament is attached.

The filament of each attachment has first and second ends. Each of the ends is formed at an acute angle relative to a line substantially perpendicular to the axis of the "T" bar to which the filament is attached.

The first "T" bar is offset relative to the second "T" bar in the plane of the attachment. Preferably the first channel portion is offset relative to the second channel portion a distance equal to the distance in which the first "T" bar is offset with respect to the second "T" bar.

To these and to such other objects which may hereinafter appear, the present invention relates to attachments for use in a double needle attacher and to a double needle attacher for use with such attachments as set forth in the following specification and recited in the annexed claims, taken together with the accompanying drawings, in which like numbers refer to like parts, and in which:

FIG. 8 is a view similar to FIG. 7 showing the "T" bars as they rotate toward their final positions;

FIG. 9 is a cross-section view of fabric sheets showing an anchored attachment;

FIG. 10 is a view similar to FIG. 5, of a second preferred embodiment of the attacher in which the cutting blades are separate from the needles.

Figures 1, 2:
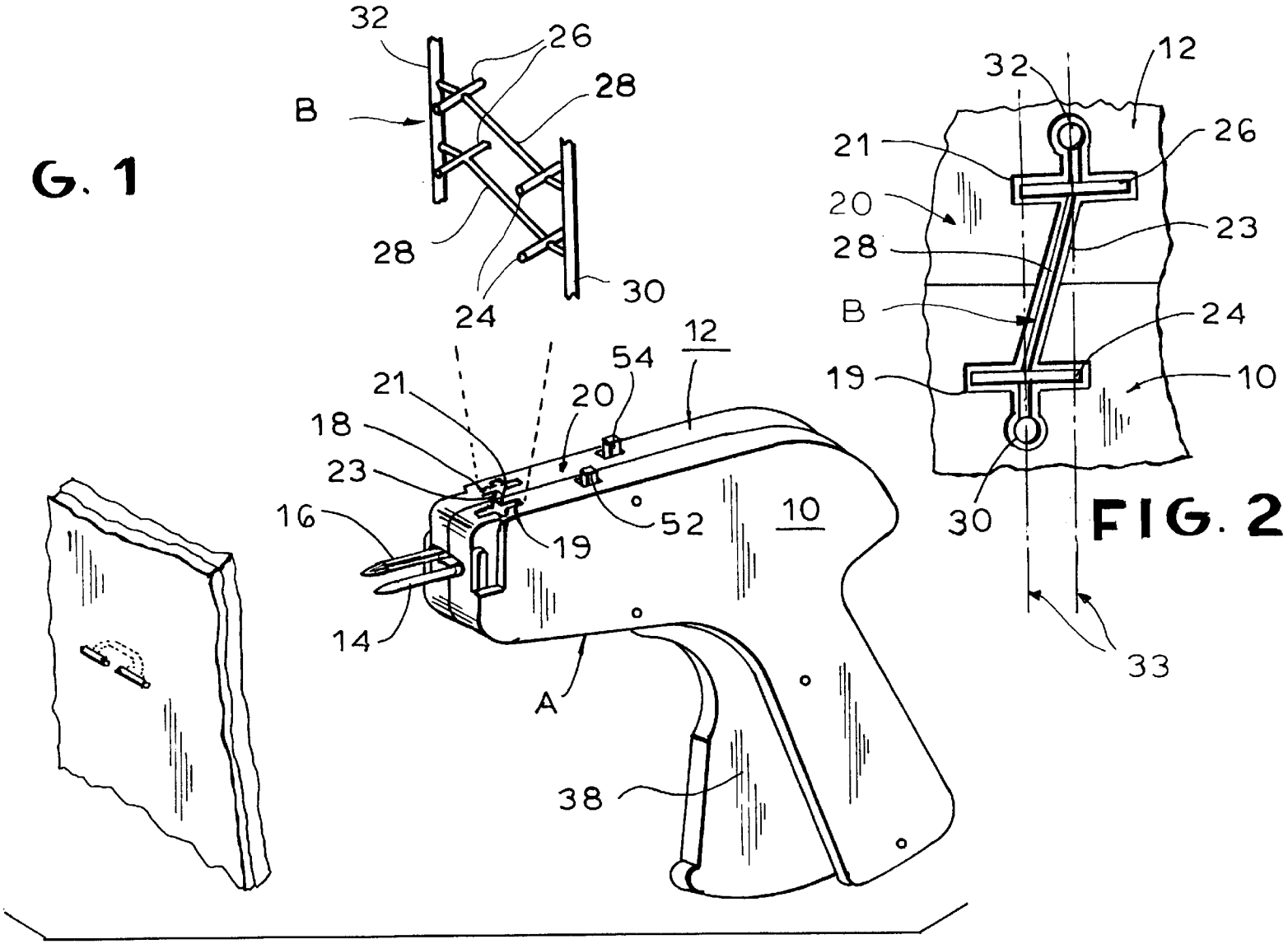
FIG. 1 is an exploded isometric view of my attachments in clip form and an attacher for dispensing same, showing an attachment anchored in sheets of fabric material.
FIG. 2 is a top elevational enlarged view of the top of the attacher housing showing an attachment in the channel.
Figure 3:
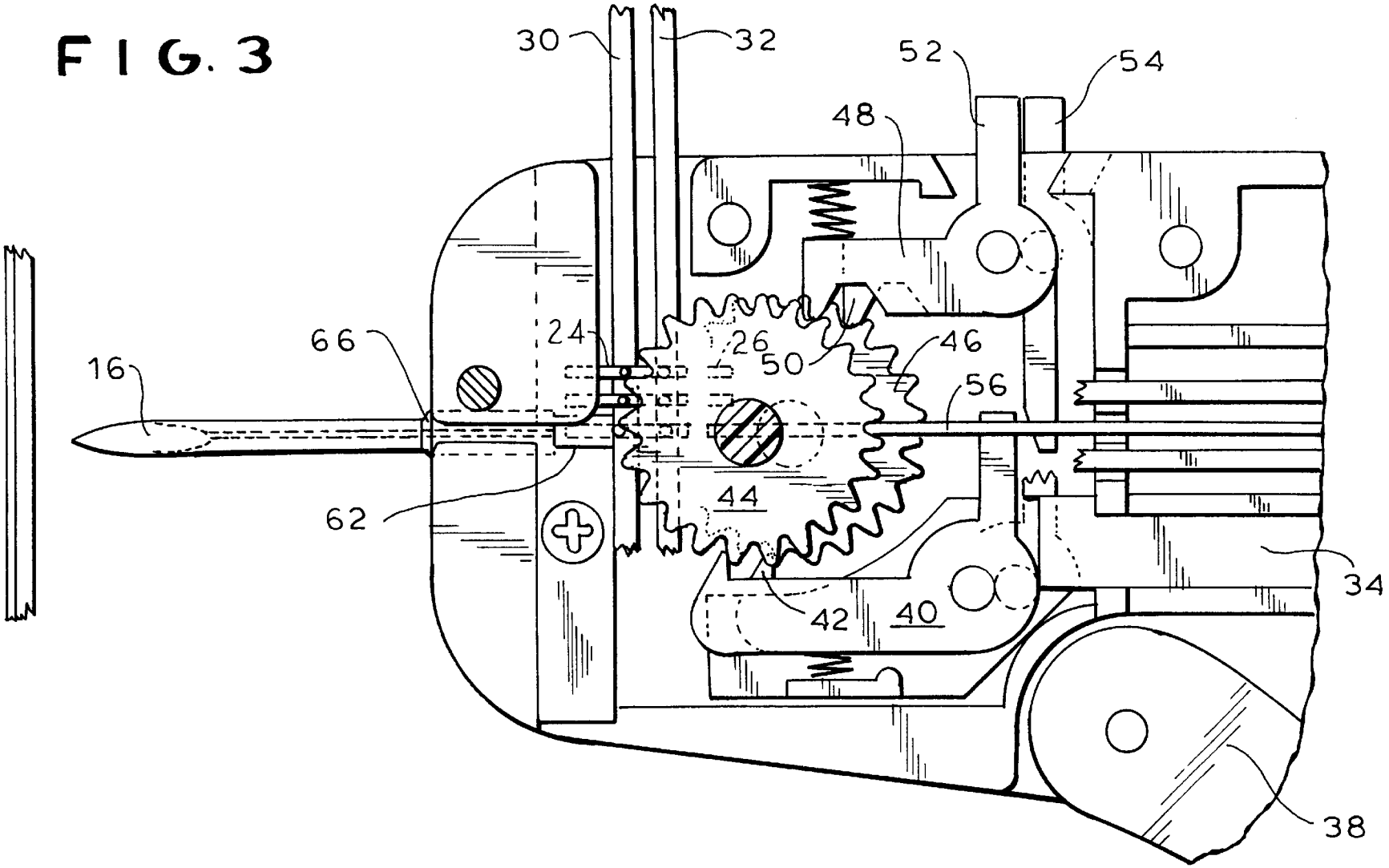
FIG. 3 is a side view of the attacher housing showing the feed mechanism.

As best seen in FIG. 1, the attacher of the present invention designed for use with the attachments in clip form consists of a housing, generally designated A, comprising two mirror image, injection molded, substantially rigid plastic housing halves 10, 12 joined together by conventional means, such as screws, to permit access to the interior of the housing for repair. Extending outwardly from the interior of the housing, through an opening in the front of the attacher, beyond the front surface of the housing, are a pair of hollow steel needles, 14, 16, each of which is formed in tube-like fashion defining a channel with a slot. Although needles 14, 16 are shown as fixed to the housing, moveably mounted needles can be utilized, if desired.

The attacher is designed to receive a clip of attachments, generally designated B, of the double "T" bar type, through a channel 18 which extends vertically through housing A and opens at the top surface 20 of the forward portion of the housing. Each clip B consists of a plurality of substantially parallel plastic attachments.

FIG. 2 shows the attachments in clip form. Each attachment consists of first and second spaced substantially parallel coplanar "T" bars 24, 26 joined by flexible filament 28. Filaments 28 are preferrably heated and mechanically stretched during the fabrication process to make them very flexible, strong and thin, as is disclosed in U.S. Pat. Nos. 4,304,743; 4,183,894; 4,416,838 and 4,429,437 to Paradis. The clips are commonly injection molded with 25, 50 or 100 attachments each.

In this form, the attachments are mounted at equally spaced intervals between connector (sometimes known as runner) bars 30, 32. The attachments of the present invention are unlike conventional attachments of this type in that the filament is longer than the shortest (perpendicular) distance between the T-bars. As referred to herein, the shortest (perpendicular) distance between the "T" bars means the distance between the "T" bars measured along a line (illustrated in phantom as lines 33 of FIG. 2) extending perpendicular to the axis of each "T" bar, when the "T" bars are spaced apart as far as possible with their axes parallel and the "T" bars offset relative to each other as shown in FIG. 2, that is, the minimum distance between parallel, offset "T" bars. These attachments differ from those disclosed in U.S. Pat. No. 5,383,260 to Deschenes mentioned above in that the filaments are stretched and lie in the same plane as the "T" bars, such that they can be stretched using conventional equipment.

The clip of attachments travels vertically through the attacher along channel 18 such that each attachment, one at a time, aligns with the plane of the needles 14, 16. Channel 18 has a shape which corresponds to the shape of the attachments and guides the attachments through the housing.

The clip of attachments is placed in channel 18 such that portion 19 of the channel is adapted to receive "T" bars 24. Portion 21 of channel 18 receives "T" bars 26. Portion 23, which connects portions 19 and 21, is adapted to receive filaments 28.

The attacher may include a mechanism for automatically advancing the clip along the channel. The clip is advanced a distance equal to the spacing between attachments, to bring the next attachment into the plane of needles, each time the attacher is actuated by depressing the trigger.

The attachment advancing mechanism includes a separate feed mechanism for each end of the attachment. Each feed machanism consists of a slide 34, 36 moveable in a direction parallel to the needles, by actuation of trigger 38. Each slide 34, 36 abuts a pivotably mounted spring loaded tooth element 40, 42 which, in turn, engages a feed wheel 44, 46.

The forward movement of the slide 34, 36 causes each associated tooth element 40, 42 to move toward the front of the attacher such that the tooth element pivots in a counterclockwise direction against a bias spring, and the tooth at the end of the element is cammed over the abutting tooth on the associated wheel. As the trigger is released, an internal spring (not shown) causes the slides and the associated toothed elements to move toward the rear of the attacher, causing each feed wheel to be rotated by the tooth of the element as it travels to index the wheel one position. Indexing the wheels moves the ends of the attachment, which are meshed in the teeth of the wheels, a distance such that the next attachment aligns with the needles.

An anti-reverse rotation parts 48, 50, associated with each wheel 44, 46, prevent the wheels from moving in a clockwise direction, as the slide 34, 36 moves forward. Each part 48, 50 has a tooth which is spring loaded toward the associated wheel and has a portion 52, 54 accessible from the top of the attacher to move the tooth away from the associated wheel and release the wheel to permit the clip to be removed from the attacher, if necessary.

Each attachment is feed in turn into alignment with the needles at the end of each trigger cycle, as the trigger returns to its initial position. Thus, the next attachment in the clip is automatically moved into firing position at the end of each stroke.

Depressing trigger 38 also causes the "T" bars 24, 26 of the attachment to be pushed through and out of the needles.

The needles have slots which face each other to permit the filament 28 to move with the "T" bars, as the "T" bars travel down the needles.

The "T" bars are pushed through the needles by a pair of ejector or push rods 56, 58. Rods 56, 58 are moved by a linkage mechanism (not shown) which is driven by movement of trigger 38. The trigger is pivotally mounted to the front of housing A so as to be moveable relative to housing A between an extended position remote from housing A and a retracted position proximate housing A. The trigger is spring loaded toward the extended position.

Squeezing the trigger toward the retracted position causes rods 56, 58 to move forward simultaneously, engage the "T" bars of the aligned attachment and push the "T" bars through needles 14, 16. In a conventional attacher, at the beginning of forward movement, the "T" bars are severed simultaneously from their respective connector bars by aligned knife blades 60, 62, which extend rearwardly from the rear of the base of each needle 14, 16.

However, in my attacher, the knife blades 60, 62 are not aligned with each other but instead are offset relative to each other such that the ends of each attachment are severed from the respective connector bars at different times during the stroke. Accordingly, the peak force necessary to sever the attachment ends from the associated connector bars 30, 32 is substantially reduced.

Each needle 14, 16 has a sharp tip at the end of a tubular metal shank, defining a channel with a slot. Each shank extends from a base 64, 66. From each base 64, 66 respectively, blade 60, 62 with a sharp edge extends. The edge of the blade 60, 62 acts to sever the "T" bar from the adjacent connector bar, as the attachment is pushed toward the needles by the rods 56, 58.

Figure 4:
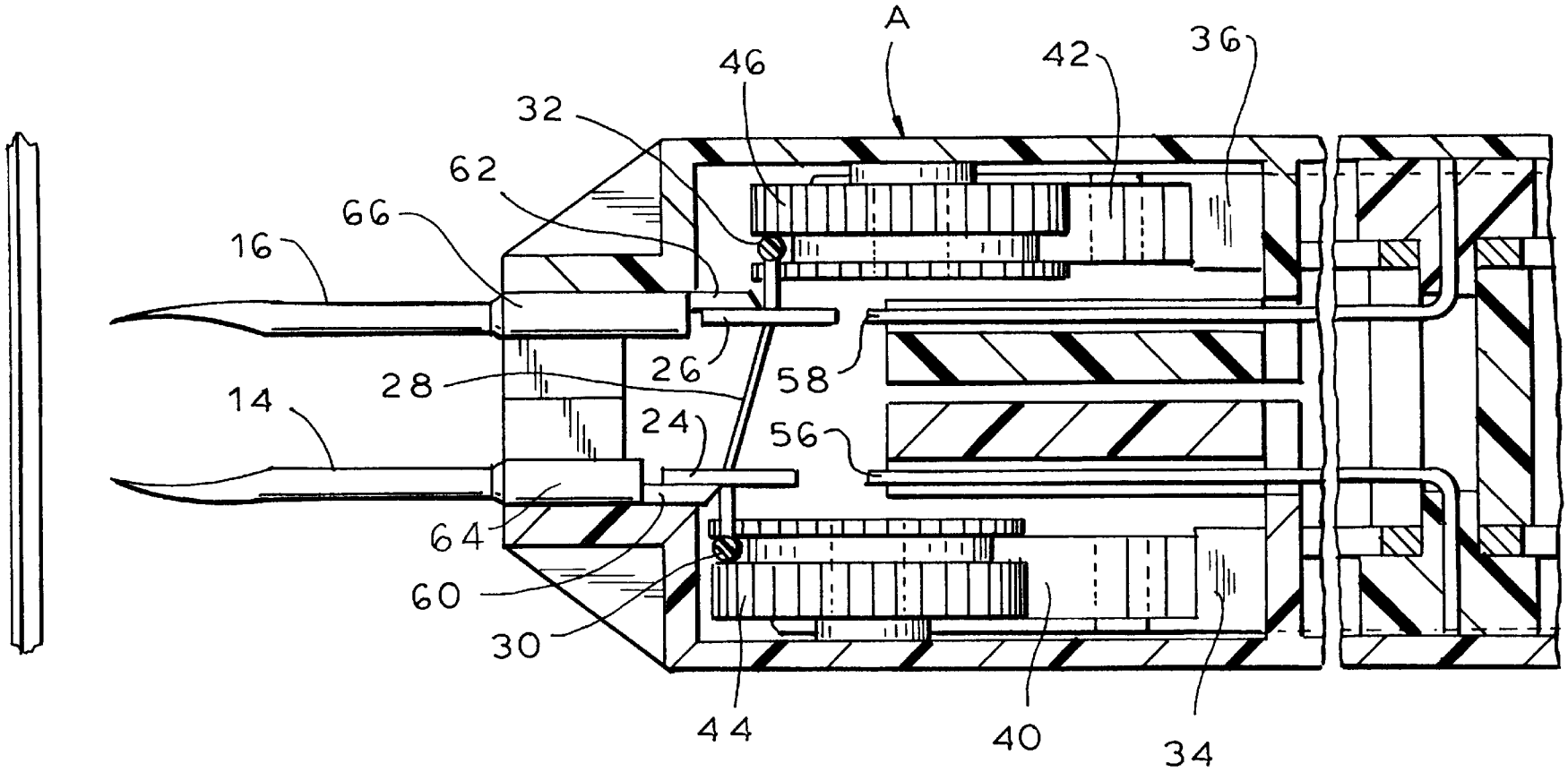
FIG. 4 is a top view of the attacher housing shown in FIG. 3.
Figure 5:
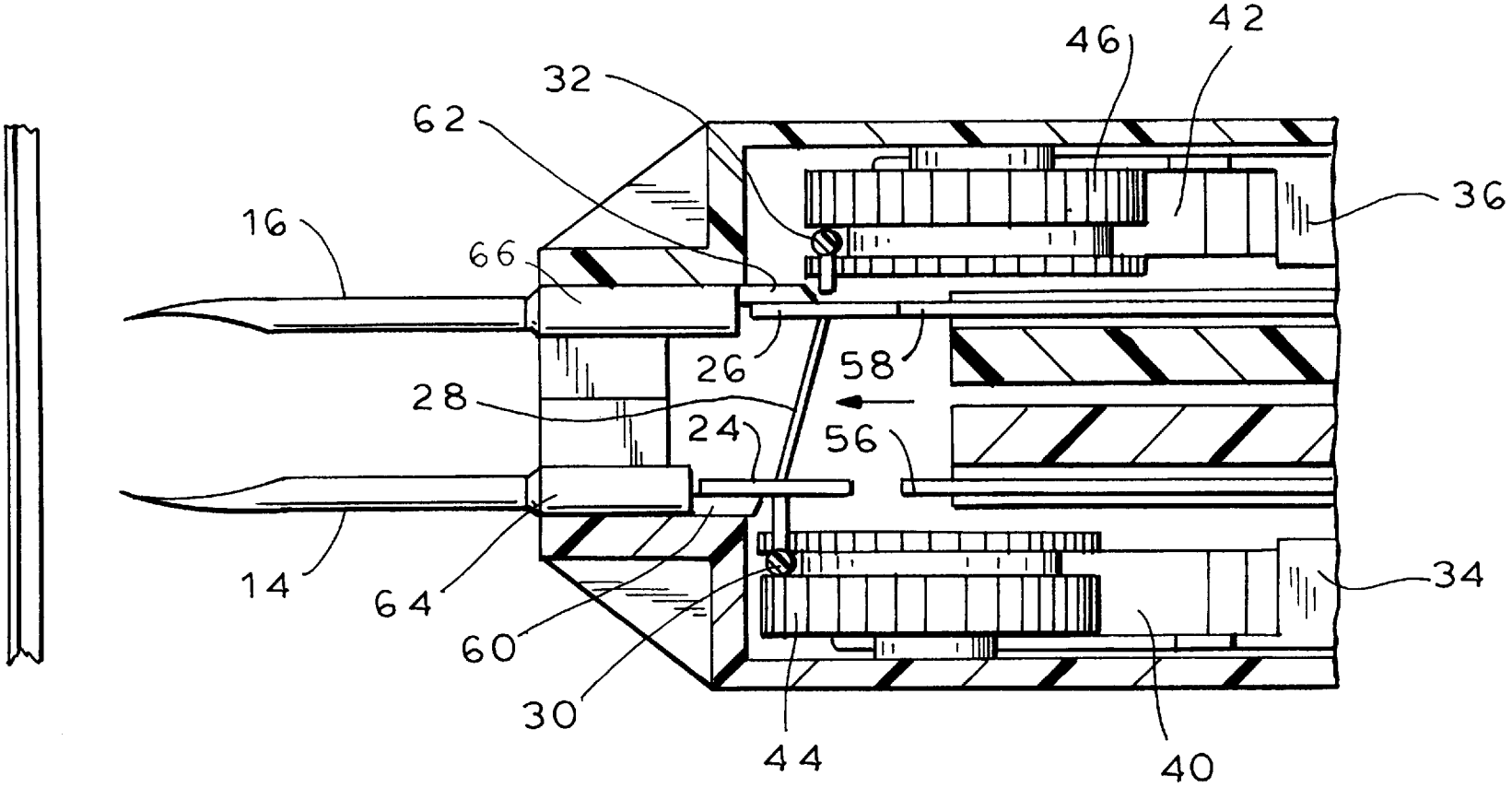
FIG. 5 is a top view of the attacher housing, showing the point in the ejection cycle where the first "T" bar of the attachment is severed.

As best seen in FIGS. 4 and 5, base 64 of needle 14 is shorter in length than base 66 of needle 16. Because of this, blade 60 is offset relative to blade 62 in the plane of the needles by a distance equal to the difference in length between base 64 and base 66. This configuration perfectly accomodates the offset locations of portions 19 and 21 of channel 18 which correspond to the offset positions of "T" bars 24 and 26. Thus, blades 60, 62 are preferrably offset to the same extent as "T" bars 24, 26.

Figure 6:
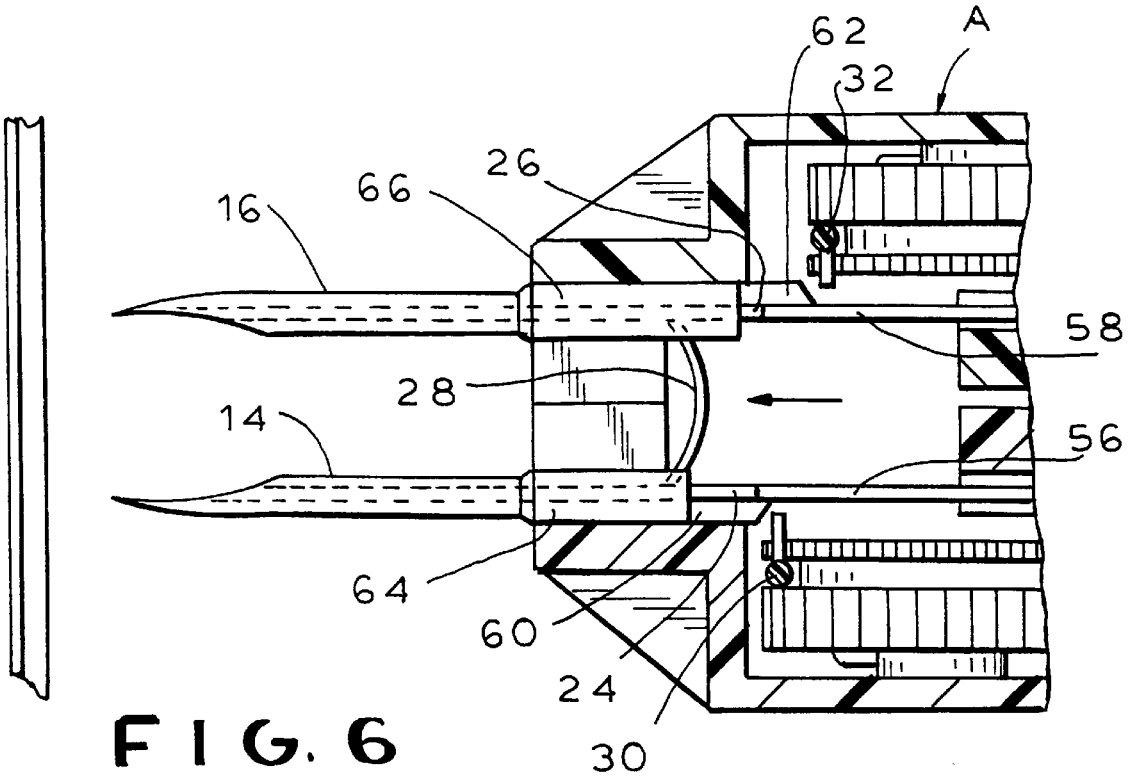
FIG. 6 is a view similar to FIG. 5 showing the point in the ejection cycle after the second "T" bar of the attachment is severed.

The result of offseting blades 60 and 62 is best seen by comparing FIGS. 5 and 6. FIG. 5 shows the ejector rods 56, 58 moving forward during the initial portion of the stroke, as the trigger begins to be squeezed. Because "T" bar 24 is offset relative to "T" bar 26, rod 58 engages "T" bar 26 first and pushes it against blade 62 to sever it from connector bar 32 before rod 56 has engaged "T" bar 24.

As seen in FIG. 6, as rods 56, 58 advance toward the needles, rod 56 engages "T" bar 24 and moves it against blade 60 to sever it from connector bar 30. Thus, the "T" bars are severed from their respective connector bars at different points in the stroke. Because filament 28 is longer that the minimum distance between "T" bars 24 and 26 (and channel portions 19, 21 align with needles 14, 16), filament 28 begins to bow (FIG. 6) as the "T" bars travel down the needles.

In conventional double needle attachers, using conventional attachments, the filaments of the attachments each have a length which is equal to the minimum distance between the "T" bars. As a result, as the ejector rods approach the end of their forward motion, the force necessary to anchor the attachment increases dramatically because in order to eject the "T" bars from the needles, and properly situate same on the far side of the fabric, filament 28 connecting the "T" bars 24, 26 must stretch beyond its original length. The stretching of the filament beyond its original length requires a great deal of force because stretching the filaments during fabrication makes them are highly resistent to additional stretching.

One solution to this problem is to use a "U" shaped non-stretched filament of the type disclosed in U.S. Pat. No. 5,383,260 to Deschenes, such that the effective length of the filament can expand as the attachment is anchored. However, it is not possible to form a stretched filament of that shape with conventional stretching equipment because the filament is in a different plane than the "T" bars.

Figure 7:
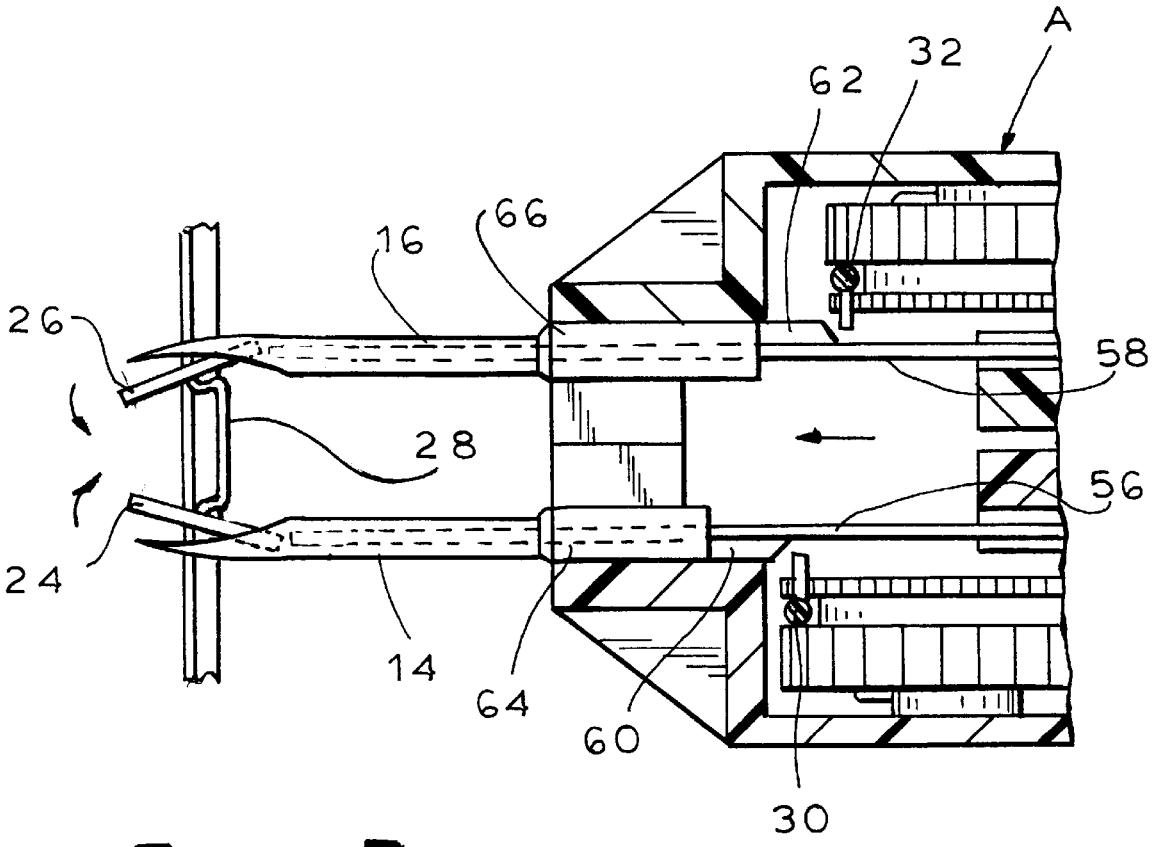
FIG. 7 is a view similar to FIG. 6 showing the ejection cycle at the point where the "T" bars are being dispensed from the needles.

This problem is overcome in the present invention by entirely elminating the need to stretch the filament beyond its original length as the attachment is anchored. Hence, stretched filaments fabricated on conventional equipment can be used. This result is achieved by fabricating the filaments to be longer than the shortest (perpendicular) distance between the "T" bars. In this way, as seen in FIG. 6, the filament will "bow" as the "T" bars travel down the needles. The slack in the filament allows the "T" bars to clear the needles, and the leading edge of each "T" bar to rotate toward inwardly their final positions, as seen in FIGS. 7 and 8, until they are parallel to the material surface, as seen in FIG. 9, without stretching the filament beyond its original length. Accordingly, no increased force is required to anchor the filament.

This result is achieved by fabricating the filament to extend in a direction which forms an actute angle with a line perpendicular to the axis of the T-bars. Thus, each end of the filament is formed at an acute angle with the line perpendicular to the "T" bar to which it is attached. This is illustrated clearly in FIG. 2.

As shown in FIG. 10, needles 14', 16' with separate cutting blades 68, 70 can also be used, instead of needles with integral blades. Here, the base of needle 14' is shown as shorter than the base of needle 16' such that blade 68 can be located at a position offset from that of blade 70.

Figure 11:
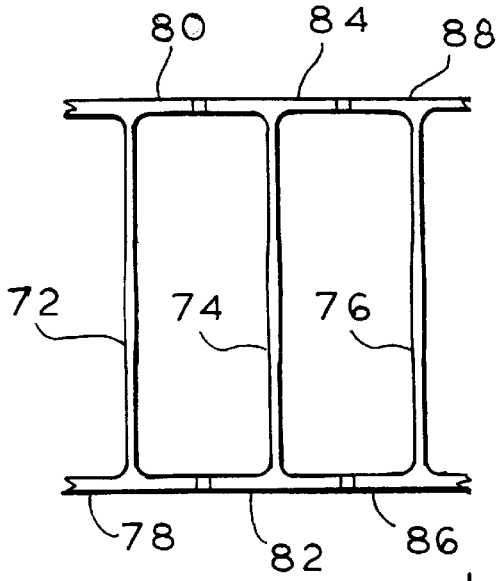
FIG. 11 PRIOR ART
FIG. 11 is a plan view of several conventional attachments in continuous ladder stock form.
Figure 12:
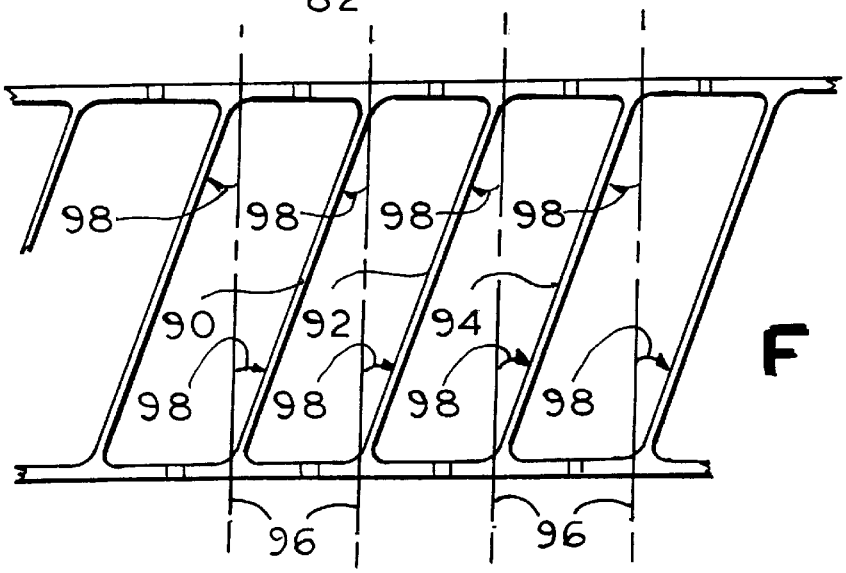
FIG. 12 is a plan view of several attachments in continuous ladder stock form in accordance with the invention.
Figure 13:
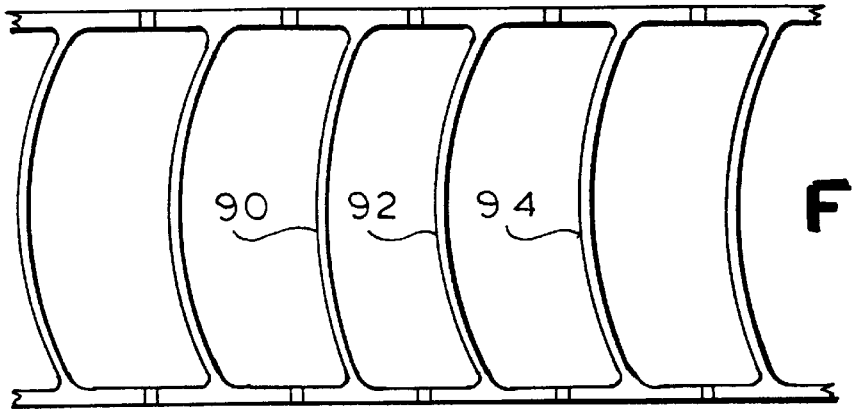
FIG. 13 is a plan view of the attachments of FIG. 12 shown as they would appear within an attacher.

FIGS. 11, 12, 13 illustrate the invention as incorporated in attachments supplied in continuous ladder stack form as disclosed, for example, in U.S. Pat. Nos. 4,533,076 and 5,615,816 mentioned above. FIG. 11 illustrates three conventional attachments of this type, each consisting of a filament 72, 74, 76 extending between connecting "T" bars 78, 80; 82, 84; 86, 88 respectively. The attachments are connected end to end. The filaments are perpendicular to the "T" bars and are as long as the shortest distance between the "T" bars. These filaments are stretched. They can be stretched during fabrication on any conventional equipment, such as that disclosed in U.S. Pat. No. 4,408,979 issued Oct. 11, 1983 to Russel.

FIG. 12 shows the attacher of the present invention in continuous ladder stock form. Each filament 90, 92, 94 is longer than a perpendicular line 96 which represents the shortest distance between the "T" bars and forms an acute angle 98 therewith. Each "T" bar at one end of an attachment is offset with regard to the "T" bar at the other end of the attachment. Each filament is in the same plane as the "T" bars. As seen in FIG. 13, when these attachments are situated within the needles in the attacher, the filaments 90, 92, 94 "bow" similar to filament 28 as seen in FIG. 6, so as to permit the "T" bars to rotate to a position adjacent the fabric sheets (FIG. 9).

It will now be appreciated that by providing a filament with a length longer that the shortest (perpendicular) distance between the "T" bars, the necessity of stretching the filament beyond its original length as the attachment is anchored is eliminated. Thus, the force required near the end of the stroke does not increase and the overall force necessary to anchor the attachment is reduced. By fabricating the filament to lie within the plane of the "T" bars, conventional stretching equipment can be utilized to fabricate the attachment.

Because the bases of the needles in the attacher are of different lengths, the cutting blades are offset. Thus, the "T" bar aligned with one needle will be severed from its connector bar slightly before the "T" bar aligned with the other needle is severed from the other connector bar. The effect of severing the "T" bars at slightly different positions during the trigger stroke is to spread out the force required at the beginning of the stroke and significantly reduce the peak force required to sever the attachment from the connector bars.

While only a limited number of preferred embodiments have been disclosed for purposes of illustration, it should be apparent that many variations and modifications could be made thereto. It is intend to cover all of these variations and modifications which fall within the scope of the present invention, as defined by the following claims:

I claim:

1. An attachment for use in a double needle attacher comprising first and second substantially coplanar "T" bars connected by a filament, said filament being situated in the plane of said "T" bars and being longer than the shortest (perpendicular) distance between said "T" bars.

2. The attachment of claim 1 wherein said filament has an end and wherein said end is formed at an acute angle relative to a line substantially perpendicular to an axis of the "T" bar to which said end is attached.

3. The atttachment of claim 1 wherein said filament has first and second ends and wherein each of said ends is formed at an acute angle relative to a line substantial perpendicular to an axis of the "T" bar to which said end is attached.

4. The attachment of claim 1 wherein said first "T" bar is offset relative to said second "T" bar in said plane.

5. The attachment of claim 1 further comprising first and second connector bars.

6. The attachment of claim 1 supplied in continuous ladder stock form.

7. A double needle attacher for use with attachments of the type having first and second "T" bars connected by a filament, the attacher comprising a housing and first and second needles extending from said housing, a channel extending through said housing along which each attachment moves, said channel having a first "T" bar receiving portion and a second "T" bar receiving portion, said first "T" bar receiving channel portion being offset relative to said second "T" bar receiving channel portion.

8. The attacher of claim 7 wherein said channel comprises a filament receiving portion extending between said first "T" bar receiving channel portion and said second "T" bar receiving channel portion in a direction other than along a line perpendicular to said "T" bar receiving channel portions.

9. The attacher of claim 7 further comprising first and second cutting blades associated with said first and second needles, respectively, said cutting blade associated with said first needle being offset from said cutting blade associated with said second needle.

10. The attacher of claim 9 wherein said cutting blades are mounted on the associated needles.

11. The attacher of claim 9 wherein said cutting blades are mounted in said housing proximate the associated needles.

12. The attacher of claim 9 wherein said needles each comprise a base and wherein said base of said first needle is shorter than said base of said second needle.

13. The attacher of claim 12 wherein said base of said first needle is shorter than said base of said second needle by a distance substantially equal to the distance by which said first "T" bar receiving channel portion is offset from said second "T" bar channel portion.

14. The attacher of claim 9 adapted for use with double "T" bar attachment in which the first "T" bar is offset relative to the second "T" bar.

15. The attacher of claim 14 wherein said cutting blade associated with said first needle is offset with respect to the cutting blade associated with said second needle by a distance equal to the distance by which said first "T" bar is offset relative to said second "T" bar.

16. The attacher of claim 7 adapted for use with double "T" bar attachment in which the filament is longer than the shortest (perpendicular) distance between the "T" bars.

17. The attacher of claim 7 adapted for use with double "T" bar attachment in which the filament has an end and wherein said end is formed at an acute angle relative to a line substantially perpendicular to an axis of the "T" bar to which said end is attached.

18. The attacher of claim 17 wherein the filament has a first and a second end and wherein each of said ends is formed at an acute angle relative to a line substantially perpendicular to an axis of the "T" bar to which said end is attached.

19. An attacher comprising a housing and first and second needles mounted to said housing, each of said needles comprising a base and an associated cutting blade, said base of said first needle being shorter than said base of said second needle such that said cutting blade associated with said first needle is offset from the cutting blade associated with said second needle.

20. The attacher of claim 19 wherein each of said cutting blades is integral with the associated needle.

21. The attacher of claim 19 wherein each of said cutting blade is mounted in said housing at a location spaced from the associated needle.

* * * * *